US008752974B2

(12) United States Patent
Leibowitz

(10) Patent No.: US 8,752,974 B2
(45) Date of Patent: Jun. 17, 2014

(54) LOW GLOW

(76) Inventor: Barry Leibowitz, Tamarac, FL (US)

( * ) Notice: Subject to any disclaimer, the term of this patent is extended or adjusted under 35 U.S.C. 154(b) by 330 days.

(21) Appl. No.: 13/049,725

(22) Filed: Mar. 16, 2011

(65) Prior Publication Data

US 2012/0236549 A1 Sep. 20, 2012

(51) Int. Cl.
*F21V 21/08* (2006.01)

(52) U.S. Cl.
USPC ..... 362/103; 362/109

(58) Field of Classification Search
USPC ..... 362/103–120
See application file for complete search history.

(56) References Cited

U.S. PATENT DOCUMENTS

| | | | | |
|---|---|---|---|---|
| 4,521,832 | A | 6/1985 | Barbour | |
| 4,599,682 | A | 7/1986 | Stephens | |
| 4,788,631 | A | 11/1988 | Fuller | |
| 4,931,913 | A | 6/1990 | Hwang | |
| 5,193,896 | A | 3/1993 | Oberlander | |
| 5,358,461 | A | 10/1994 | Bailey, Jr. | |
| 5,568,971 | A | 10/1996 | Jewell | |
| 6,056,412 | A | 5/2000 | Atlee et al. | |
| 6,213,619 | B1 | 4/2001 | Yu | |
| 6,529,121 | B2 | 3/2003 | Bush | |
| 6,547,728 | B1 * | 4/2003 | Cornuejols | 600/300 |
| 6,550,930 | B1 | 4/2003 | Portouche | |
| 6,554,445 | B1 | 4/2003 | Jacoby | |
| 7,165,859 | B1 | 1/2007 | Munari | |
| 7,377,665 | B2 | 5/2008 | Langenwalter | |
| 7,568,813 | B2 | 8/2009 | Barker | |
| 2002/0131266 | A1 * | 9/2002 | Naghi et al. | 362/104 |
| 2007/0014107 | A1 * | 1/2007 | Mishan | 362/190 |
| 2009/0290329 | A1 | 11/2009 | Barker | |
| 2010/0202136 | A1 * | 8/2010 | Vittozzi | 362/183 |

* cited by examiner

*Primary Examiner* — William Carter
(74) *Attorney, Agent, or Firm* — Fleit Gibbons Gutman Bongini & Bianco, PL; Paul D. Bianco; Gary S. Winer

(57) ABSTRACT

A pace setting device having a cylinder, top circular slab, a circular wall, an enclosed region; a piece of material connected at the top circular slab and a cuff at the cylinder base. The device has multiple springs connected between the cylinder and the piece of material holding the piece of material and the cylinder together. The piece of material serves as a large touching zone for athletic pace setting. A row of LEDs arranged within cavities that perforate the circular cylindrical wall are lighted by a battery having a snap terminal connected to a first jumper connection and a push button device operable to activate a lighting circuit made of the row. The first jumper connection is connected to two resistors that are respectively connected to two sets of differently colored LEDs and a second jumper connection having connections to both sets of LEDs and the push button device.

8 Claims, 7 Drawing Sheets

LOW GLOW

CROSS REFERENCE TO RELATED APPLICATIONS

N/A

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the United States Patent and Trademark Office patent file or records, but otherwise reserves all copyrights whatsoever.

BACKGROUND (1) Field of the Invention

Relating to improvements in training mechanisms used in exercise regimens for both men and women. More specifically, relating to improvements in devices utilizing a pace setting aid.

(2) Existing Technologies

There are many computer based pace setting equipment in existence that time the movements of persons in various sports. Optical measuring devices capture the movement of athletes and translate the detected data into pace setting and measuring outputs. However, the inclusion of computers, sensors and auxiliary equipment is expensive and cumbersome. Thus, what is needed is a simple device that can easily facilitate setting and maintaining the pace of exercises in an inexpensive and simple fashion.

BRIEF SUMMARY OF THE INVENTION

A cylindrical pace setting device having a cavity filled by a door at a base region forming a space for adhesion of circuit elements at the interior surface of an enclosed region (top interior, bottom interior, interior walls); at the opposite side of the door is a circular top wall that has a small central opening for insertion of a switch. A Velcro activated cuff is connected to the back of the cylinder. The device has multiple springs connected between the cylinder and the piece of material holding the piece of material and the cylinder together. The piece of material serves as a large touching zone for athletic pace setting. A row of LEDs arranged within cavities that perforate the surface of the circular cylindrical wall are lighted by a battery having a snap terminal connected to the first jumper connection and a push button device operable to activate the lighting circuit. The first jumper connection is connected to two resistors that are respectively connected to two sets of differently colored LEDs and a second jumper connection having connections to both sets of LEDs and the push button device.

The internal parts are glued, taped, arranged in molded plastic slots, bolted (nut and bolt), snap-in plastic part moldings or combinations of the foregoing. Further, the springs are connected to the piece of material and to the cylinder's top circular slab that has been integrated with a circular wall and an enclosed region therein. The springs can be glued, taped, the ends of each inserted in slots for holding it in place or combinations of the foregoing.

The large piece of material is a hemisphere or similar type of surface for easy accessibility during athletic training. In particular, the hemisphere is a representation of a sports item so as to situate the item in the particular field where training occurs such as soccer, basketball or similar sports. Additionally, the piece of material is substantially similar to the size of the enclosed region of the cylinder, in other words, of a size that it is of nearly the same size as the enclosed region as practical.

DETAILED DESCRIPTION OF THE INVENTION

The following is a detailed description of the preferred embodiment with respect to FIGS. 1-5.

Figure 1:
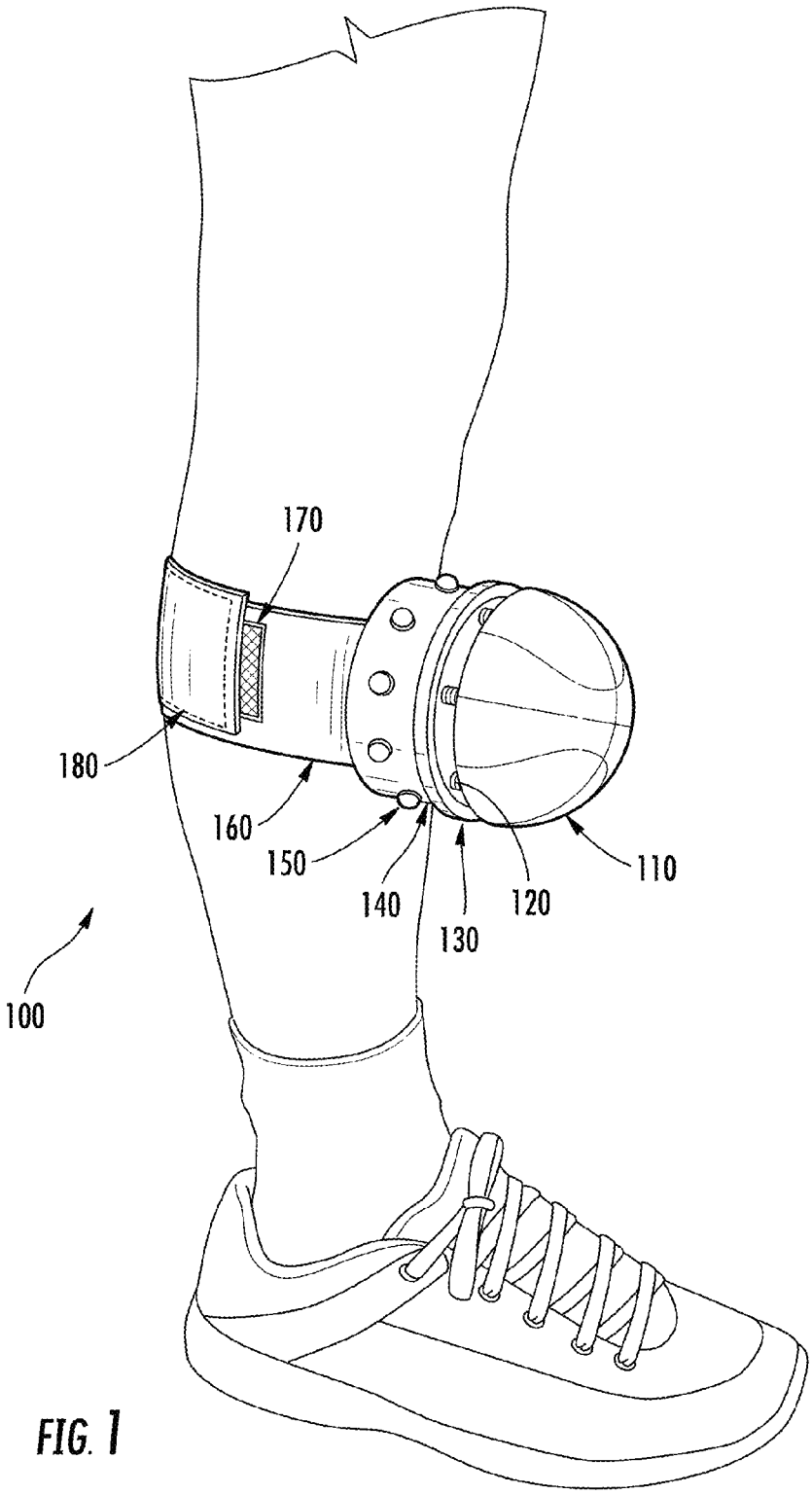
FIG. 1 illustrates the application of an embodiment as applied to the legs of an athlete showing various features.
Figure 2A:
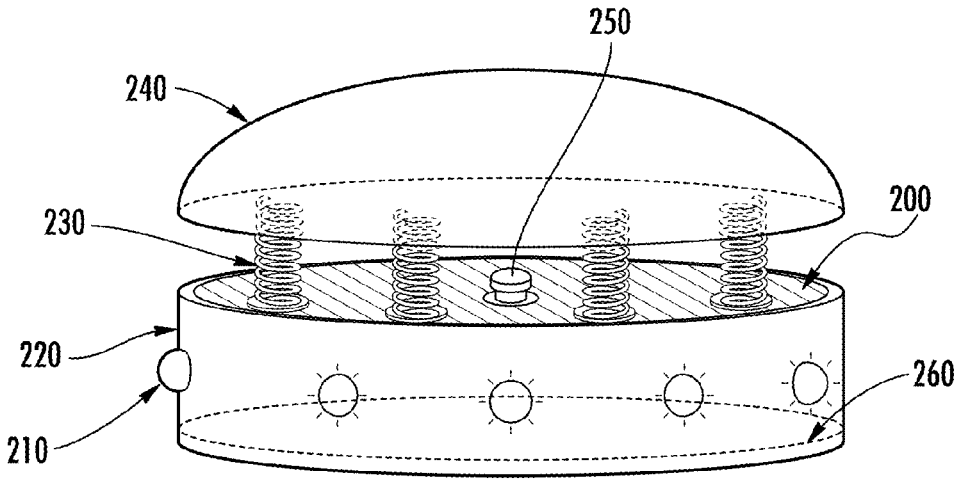
FIG. 2 illustrates various external and internal structures of an embodiment as taught herein.
Figure 2B:
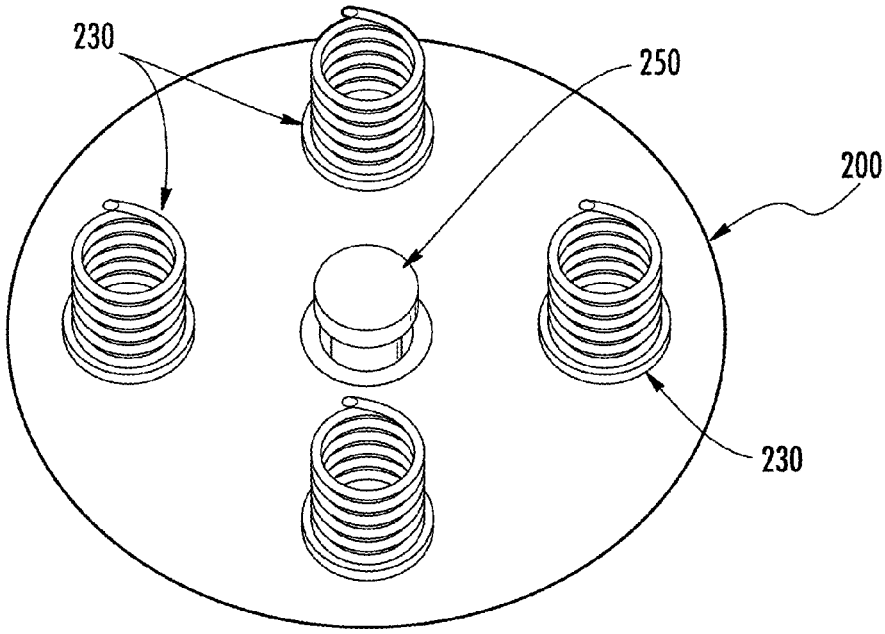
Figure 2C:
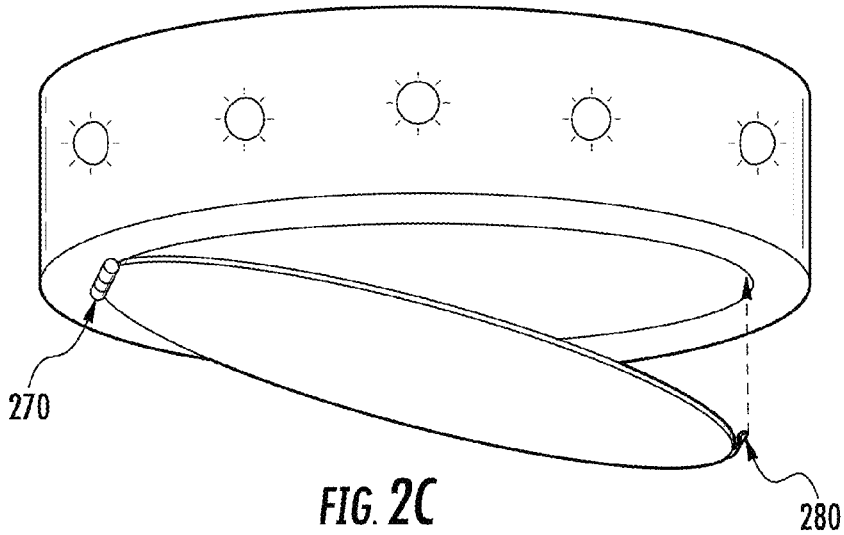
Figure 2D:
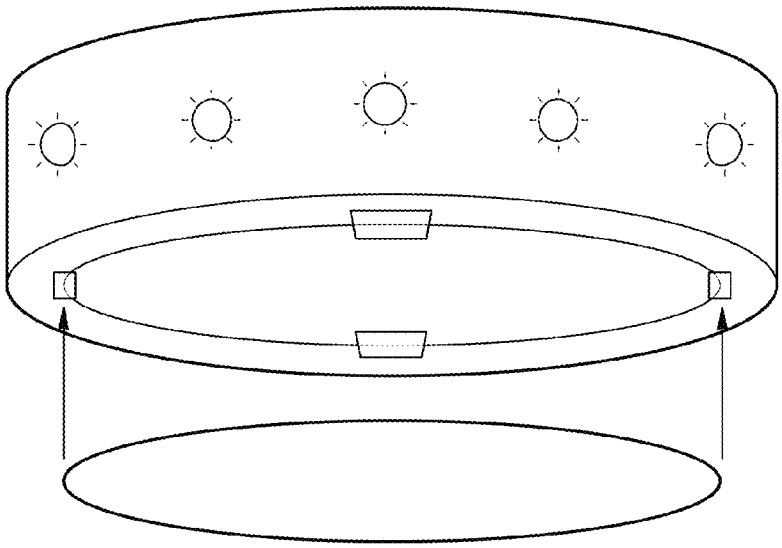
Figure 2E:
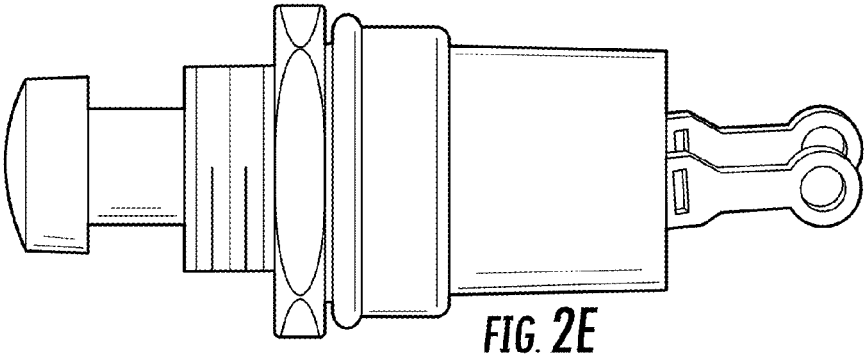
Figure 2F:
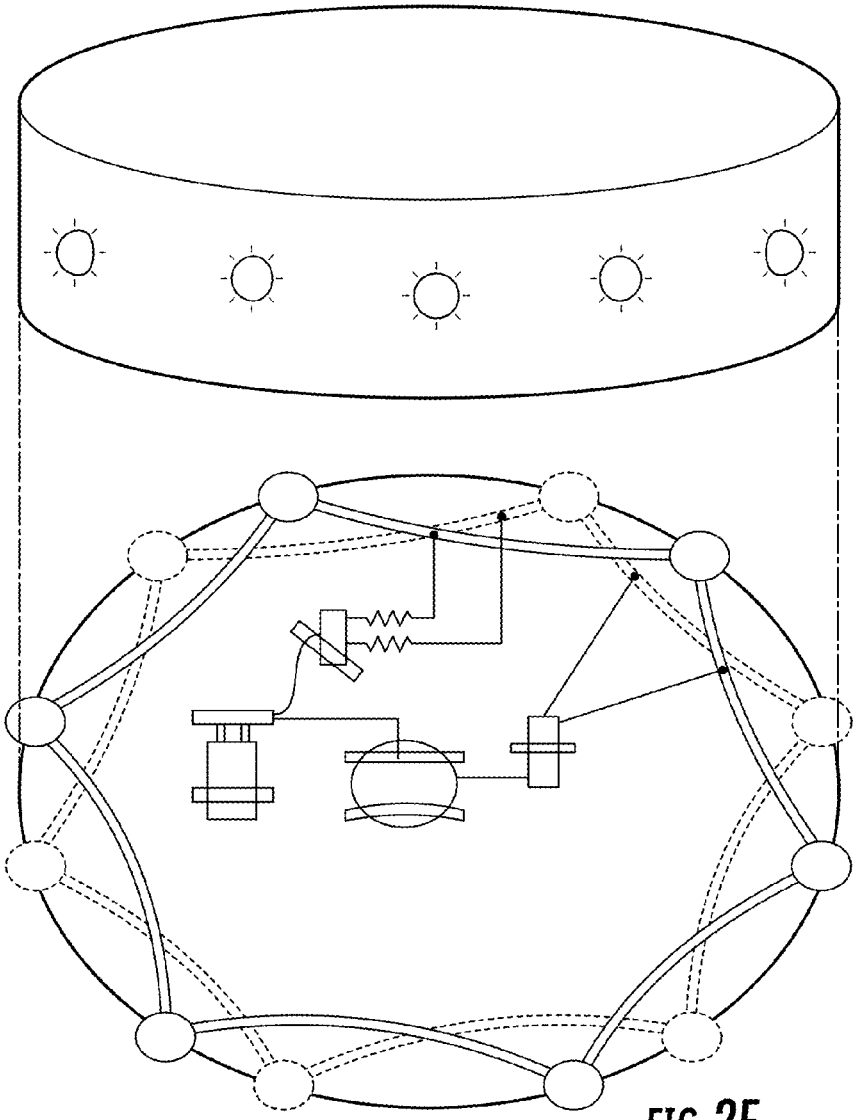

FIG. 1 illustrates the application 100 of an embodiment as applied to the legs of an athlete showing various features. A (plastic, non-rigid or foam) hemisphere 110 of material is attached through the use of several glued springs 120 to a wide top surface 130 (PVC or similar material); this serves as a top portion for a reversed (PVC or similar plastic) cylinder 140 that has a hollow internal area for insertion of electrical components. The springs 120 are glued to the top 130 of the hollow cylinder 140. Alternatively the springs' ends are threaded into corresponding slots that are found at the top of the hollow cylinder 140. Similarly, the springs 120 are either glued or connected to the underside of the hemisphere (plastic, non-rigid or foam) using corresponding slots. The cylinder 140 has two banks of LED lights 150 alternatively RED and WHITE that are placed in a plurality of cavities arranged around the circumference of the cylinder 140 such that the cavities perforate the cylinder allowing for each of the LEDS 150 to be in electrical connection with other components of the circuit as taught below. An attachment cuff(s) 160 made of a generic material such as polyester, cotton, spandex or similar material is shown having VELCRO material sewn into or otherwise attached to it in a conventional fashion. VELCRO is a brand name of fabric hook-and-loop fasteners; the cuff 160 has a matching set (170,180) arranged on an external side of the cuff 170 and on an inner side 180 of the cuff 160 so as to enable engagement of the VELCRO material by user interaction with the cuff placing one over the other. The cuff 160 is attached to the external face of the bottom side of the cylinder 140 through the use of glue; alternatively plastic bolt and nut combination perforating the bottom of the cylinder will accomplish the same.

FIG. 2 illustrates various external and internal structures of an embodiment as taught herein. The top surface 200 of cylinder 220 is as shown in FIG. 2A. Just below the top surface 200 is a row of red and white LED lights 210 extending from the inside of the cylinder through the cylinder material and breaching the outside surface of the cylinder 220 so as to provide a light indication as discussed below. Springs 230 are glued or inserted in slots on the top surface 200 of the cylinder and at the bottom side of hemisphere 240. The bottom surface of the hemisphere 240 is in contact with a push button switch 250 that is utilized to practice the invention. The switch 250 is situated in a hole central to the top surface slab and between the springs; it can be glued or taped to the slab 200. When a user pushes down upon the surface of the hemisphere 240 it presses down upon the top surface of the push button switch that slides down upon application of sufficient pressure to the top of the hemisphere. The pushbutton switch thus enables the activation of the banks of LED lights 210 through the use of electronic circuitry described in further detail in FIGS. 3-5. FIG. 2B shows a top down view of the symmetrical arrangement of four springs 230 about the center where the push button switch is centrally located. Similarly, when user pressure is no longer applied to the hemisphere 240 the springs push back upon it and the hemisphere moves upwards and as a consequence the switch 250 returns to its off position; as a result, the LED lights 210 are deactivated. FIG. 2C shows a hinged door 270 arrangement and mechanical clasp 280 that closes the enclosed region within the cylinder. FIG. 2D shows an outer door 290 that is taped or glued in place forming an enclosed space in the cylinder for the storage of electrical components. FIG. 2E shows a typical push button part for the circuit. FIG. 2F shows a typical taping arrangement for the circuit.

Figure 3:
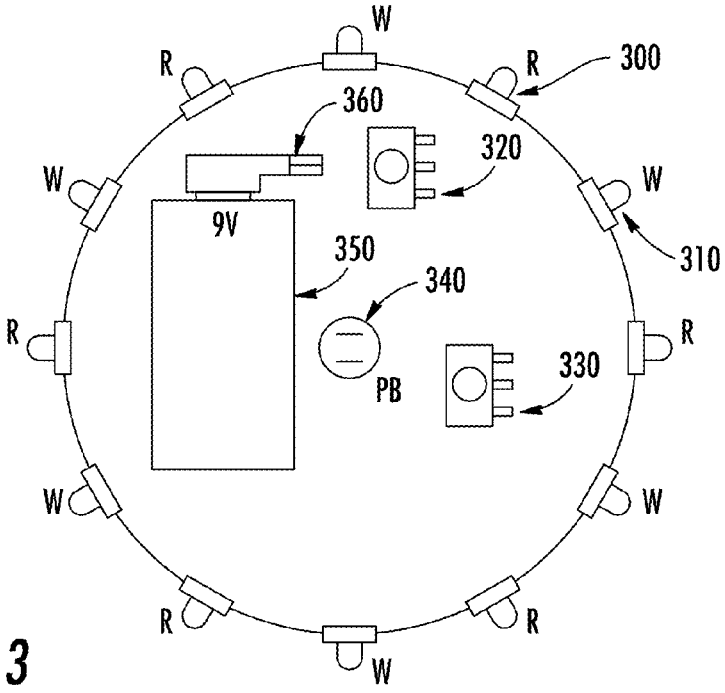
FIG. 3 illustrates an electrical circuit overview showing various electrical components of an embodiment.

FIG. 3 illustrates an electrical circuit overview showing various electrical components of an embodiment. A half dozen red 300 and a half dozen white 310 LEDs are arranged in a circle about the cylinder previously described. FIG. 3 only shows how these components are arranged about the surface of the cylinder not their specific electrical connections; that will be shown with respect to FIGS. 4-5. Jumper interconnects 320 and 330 are shown having three connection points and realized in WAGO part #859-403. A push button switch 340 is shown schematically as radio shack part #275-1547 that is used to make electrical connection and complete the circuit. A 9V battery 350 and snap-on battery terminal 360 are shown in the figure as ULTRALAST/PART #55039849 and RADIO SHACK/PART #270-325. The 9V battery serves as the only power source for the LOW GLOW device. When applied to the inner cylinder enclosed space, the various electrical components disclosed herein are taped or glued according to the wiring circuitry layout of FIGS. 3-4 in a convenient fashion according to the implementation. The walls of the cylinder, underneath, i.e., inside of the top slab and the bottom region (door or door edge area) may also be used to tape the devices herein.

Figure 4:
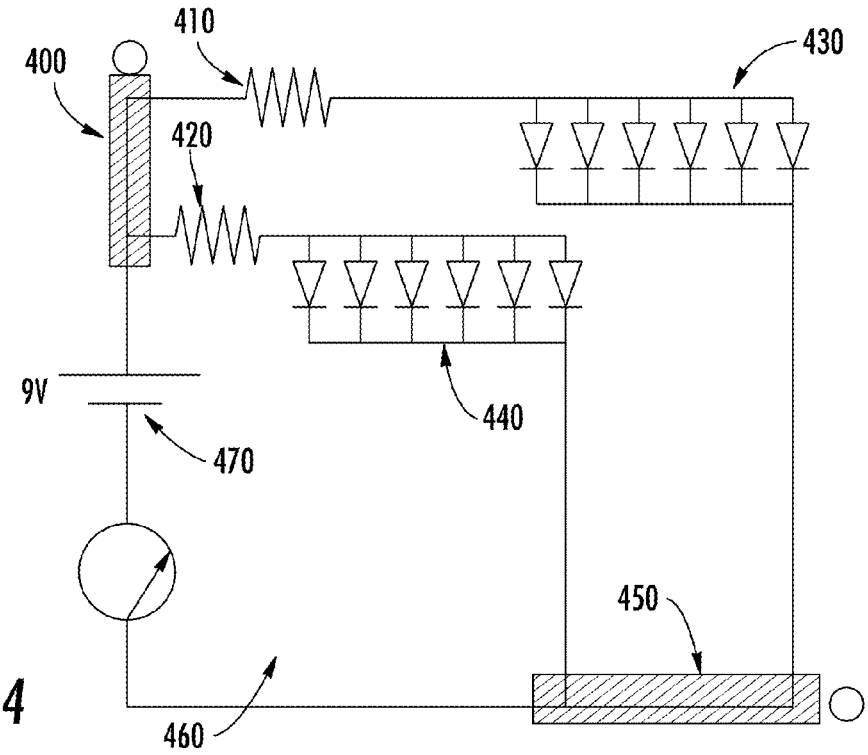
FIG. 4 illustrates an electrical circuit diagram of an embodiment showing the interrelation between various electronic parts.
Figure 5B:
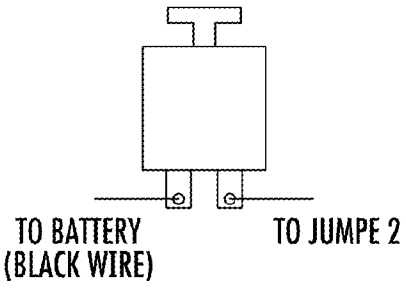
FIG. 5 illustrates an electrical circuit overview showing various other features of electrical components of an embodiment.
Figure 5E:
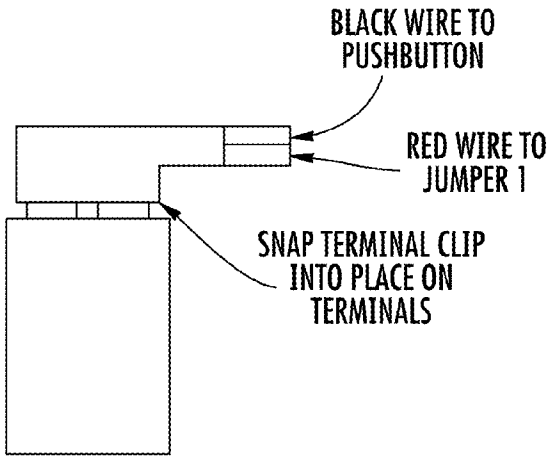
Figure 5A:
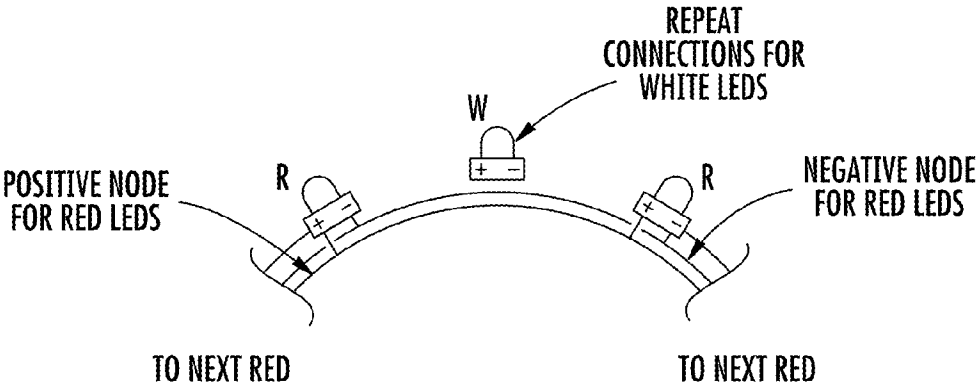
Figure 5D:
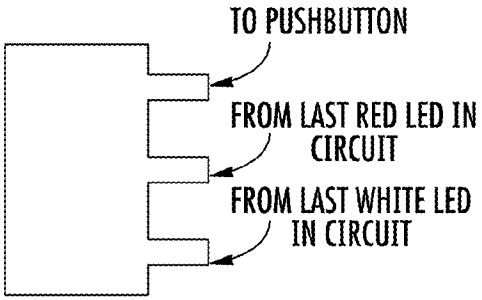
Figure 5C:
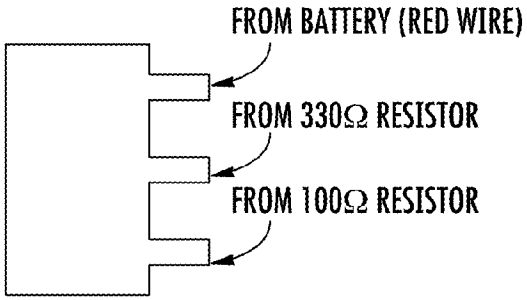

FIG. 4 illustrates an electrical circuit diagram of an embodiment showing the interrelation between various electronic parts. A three-connection jumper WAGO part #859-403 node 400 connects three circuit legs in parallel. The first leg connects through a load resistor 410 herein shown as a 100 ohm resistor RADIO SHACK/PART 271-1108 that connects to a set 430 of six RADIO SHACK/PART 276-017 WHITE LEDs; this set 430 is itself an arrangement of parallel LEDs as shown in the drawings. Typically, the LEDS are 25 mA rated LEDS and are finally connected to another three connection jumper 450 interconnect WAGO part #859-403. In a similar fashion the second leg of the circuit connected to jumper interconnect 400 has a current limiting resistor 420 herein shown as a 330 ohm resistor RADIO SHACK/PART 271-1113 that connects to a set 440 of six RADIO SHACK/PART 276-026 RED LEDs; this set 440 is itself an arrangement of parallel LEDs as shown in the drawings. Typically, the LEDS are 28 mA rated LEDS and are finally connected to another three connection jumper 450 interconnect WAGO part #859-403. The final leg of the circuit has a push button 460 connected in series with a 9 Volt battery as shown. When a user applies pressure to the hemisphere of material the pushbutton is depressed, as a consequence it activates the circuit described above. Current flows from the battery through the two banks of LEDS lighting up the area around the external part of the hollow cylinder previously described. Thus, this light indicates to a user that a particular pace is being kept and so an instructor or group of athletes can maintain timing during an exercise regimen. When a user releases the pressure on the hemisphere of material the springs push back on the hemisphere returning it to its original location. In this fashion, the push button switch is no longer in the active position and current ceases to flow in the circuit and as a consequence the lights turn off.

FIG. 5 illustrates an electrical circuit overview showing various other features of electrical components of an embodiment. FIG. 5A illustrates how the Red LEDs cathodes are arranged together and how the Red anodes are arranged together. FIG. 5A indicates that the White LEDs cathodes and anodes are arranged together like their red counterparts. Once the red and white LEDs are connected in parallel with conventional electrical wiring the individual lights are placed inside the cavities along the inner surface of the cylinder. Each of the lights exits its respective cavity just enough so as to be visible externally; they are arranged so as to alternate white red white to red about the cylinder; to finish off the attachment of the device, glue and or tape hold the electric wiring and LEDs to the inner surface of the cylinder. FIG. 5B illustrates how a pushbutton switch has connections both to the 9V power source and jumper interconnection 450. FIG. 5C illustrates how jumper interconnection 400 has three connection devices from the battery, the 330 ohm and 100 ohm resistors. Similarly, FIG. 5D shows how jumper interconnection 450 has three connection devices from the pushbutton 460, from the last RED LED in the circuit and from the last WHITE LED in the circuit. FIG. 5E shows a typical 9V power source 470, 350 having a snap-on connection 360. The snap-on connector as its name implies snaps-on to the terminals of the battery; the other terminals of the connector 360 go to the pushbutton 460 and to the jumper interconnection 400.

Figure 6:
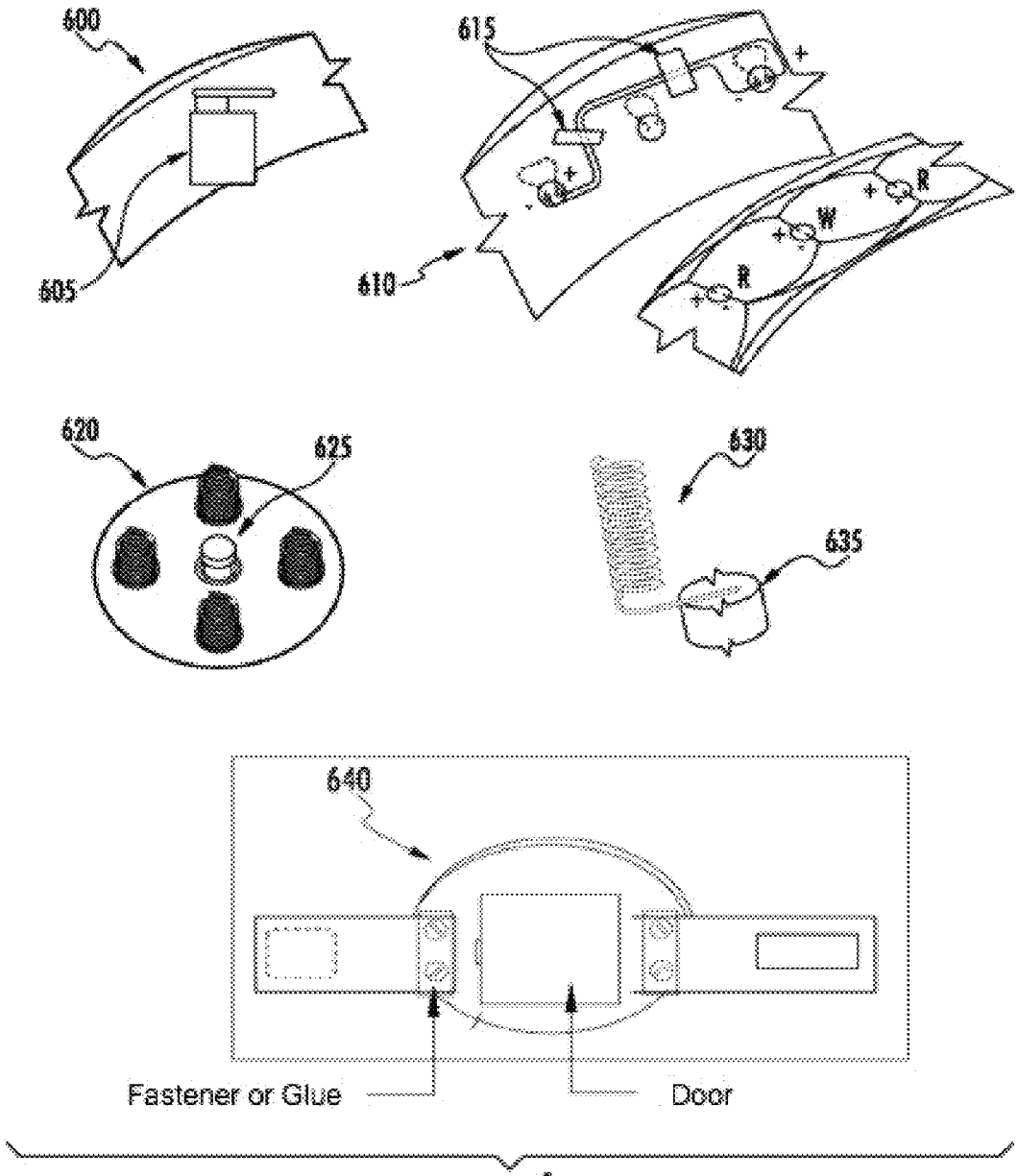
FIG. 6 illustrates various connection schemes used in an embodiment.

FIG. 6 shows various attachment mechanism used in various implementations. The first view 600 has an item (power supply and snap connector) glued 605 to the inner surface of the cylinder. It may also be taped or located on the internal bottom surface (door or door edge area) or inner top of the cylinder. The next view 610 shows how the LEDs are wired by skipping one LED in between whereby the electric wiring between each member of a set is taped 615 to the wall of the inner cylinder. The next view 620 has a plastic slot 625 for the push button whereby physical snap-in effects the connection. The plastic slot is molded right out of the internal piece of the cylinder or is itself glued to the inner surface. The next view 630 shows the end of spring can be loaded into a small notch or hole and glued therein 635. The next view 640 shows how in one implementation bolt(s), nut(s) and or glue 645 are used to connect the cuff member(s) to the internal and external surface of the cylinder bottom. In this particular, implementation the cuff member is divided into two pieces with Velcro hooks and loops located on a different one and corresponding appropriate sides of the two pieces. Glue and or bolt fasteners hold the cuff pieces to the backside of the cylinder as shown.

A door opens and closes between them facilitating access to the internal electrical parts. Optionally, one cuff may be laid across the back of the device.

The two jumper interconnects, battery and terminal are glued and or taped to the inner bottom, sides and or top of the cylinder depending upon the needs of the implementation. The push button switch is situated in a hole and is glued and or taped to the center interior top of the cylinder; alternatively, a slot is provided with a metal threading to ensure the fit of the device. Other connection schemes have any of the various parts internal to the cylinder being designed to be glued and or taped and or screwed in a metal sheath, placed in molded slots with a mechanical connection either through glue, physical compression with a plastic 'snap-in' effect whereby the plastic or metal holder expands to hold the device and then snaps on to a particular item, or bolt and nut type connection or combinations of the foregoing. However, the preferred system is gluing the various devices to internal surfaces and taping them for a good fit. The entire LOW-GLOW device is designed to be worn on the leg or the arm either as a single device or with a duplicate device on the other limb. The hemisphere of (plastic, non-rigid or foam) material is a representation of a sports item such as a soccer ball or basketball.

The invention has thus been described in such clear and precise terms as to enable one of ordinary skill in the art to understand its fundamental principles.

I claim:

1. A pace setting device comprising:

a cylinder having a top circular slab integrated with a circular wall and an enclosed region wherein a piece of material is connected at the top circular slab;

a cuff connected to a base of the cylinder;

multiple springs connected between the cylinder and the piece of material holding the piece of material and the cylinder together;

a battery having a terminal connected to a first jumper connection;

a switch operable to activate a lighting circuit including a row of LEDs arranged about a perimeter of the circular cylindrical wall, the LEDs powered by the battery; and wherein the first jumper connection is connected to two resistors that are respectively connected to two sets of differently colored LEDs of the row of LEDs, and a second jumper connection having connections to both sets of LEDs and the switch.

2. The pace setting device of claim 1, wherein various internal parts are glued to an interior surface of the cylinder.

3. The pace setting device of claim 1, wherein various internal parts are arranged in slots on an interior surface of the cylinder.

4. The pace setting device of claim 1, wherein various internal parts are arranged taped on an interior surface of the cylinder.

5. A sports training device comprising:

a base having a top wall, a bottom wall, and at least one side wall together defining a cavity;

a bumper defining a hemisphere, the bumper having a top surface and a bottom surface, the bumper positioned entirely above the base, the bumper fabricated with a resilient material;

a biasing element disposed on the top wall of the base, the biasing element further configured to connect the top wall of the base to the bottom surface of the bumper;

wherein the bumper is displaceable in connection with the biasing element between a first position and a second position, wherein the second position is closer to an exterior surface of the top wall of the based;

a switch configured to form an electrical connection when the bumper is moved in connection with the biasing element to the second position;

a plurality of lights disposed on a portion of the side wall forming an exterior surface of the base, wherein the plurality of lights are activated when the electrical connection of the switch is formed;

an adjustable strap attached to the base, wherein the adjustable strap is sized and dimensioned to fit at least one of a forearm, upper arm, shin, and thigh of a user of the sports training device; and an electrical circuit disposed within the cavity of the base including a first jumper connection and the switch, wherein the first jumper connection is connected to at least two resistors, the at least two resistors are connected to the plurality of lights and the second jumper connection having connections to the plurality of lights and the switch and a power supply operative to energize the electrical circuit when the switch is closed.

6. The sports training device of claim 5, wherein the bottom wall of the base has a hinged door for easy access to the cavity of the base.

7. The sports training device of claim 5, wherein the plurality of lights are LEDs arranged in a row and disposed within cavities that perforate the the portion of the side wall forming an exterior surface of the base.

8. The sports training device of claim 5, wherein the switch is a momentary switch which is only active while the bumper is in the second position.

* * * * *